US012061033B2

(12) United States Patent
Kim et al.

(10) Patent No.: US 12,061,033 B2
(45) Date of Patent: Aug. 13, 2024

(54) ICE MAKER AND REFRIGERATOR HAVING THE SAME

(71) Applicant: LG Electronics Inc., Seoul (KR)

(72) Inventors: Yonghyun Kim, Seoul (KR); Jinil Hong, Seoul (KR); Seunggeun Lee, Seoul (KR); Seungjin Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/738,269

(22) Filed: May 6, 2022

(65) Prior Publication Data

US 2022/0260297 A1 Aug. 18, 2022

Related U.S. Application Data

(63) Continuation of application No. 16/685,675, filed on Nov. 15, 2019, now Pat. No. 11,353,253.

(30) Foreign Application Priority Data

Nov. 16, 2018 (KR) ..... 10-2018-0142125

(51) Int. Cl.
*F25C 1/25* (2018.01)
*F25C 1/24* (2018.01)

(52) U.S. Cl.
CPC ..... *F25C 1/25* (2018.01); *F25C 1/24* (2013.01); *F25C 2400/10* (2013.01)

(58) Field of Classification Search
CPC ..... F25C 1/25; F25C 1/24; F25C 2400/14; F25C 1/10; F25C 5/22; F25C 2305/02
See application file for complete search history.

(56) References Cited

U.S. PATENT DOCUMENTS

2006/0086134 A1* 4/2006 Voglewede ..... F25C 5/06 62/353
2009/0178431 A1* 7/2009 Cho ..... F25C 1/04 62/345

(Continued)

FOREIGN PATENT DOCUMENTS

CN 105352240 2/2016
EP 2578969 4/2013

(Continued)

OTHER PUBLICATIONS

Extended European Search Report in European Appln. No. 19209295, dated Apr. 3, 2020, 9 pages.

(Continued)

*Primary Examiner* — Elizabeth J Martin
(74) *Attorney, Agent, or Firm* — Fish & Richardson P.C.

(57) ABSTRACT

An ice maker includes: an upper assembly comprising a plurality of upper chambers recessed upward to define an upper portion of an ice chamber in which water is filled and ice is made, and having an intake opening by being open on a top, and a vertical extension part formed to protrude upward around the intake opening; a lower assembly comprising a plurality of lower chambers recessed downward to define a lower portion of the ice chamber, and rotatably connected to the upper assembly; and a water supply part that is recessed downward from an upper side of the water supply part and configured to receive therein water for making ice, the water supply part being removably coupled to the vertical extension part and configured to guide the received water into the intake opening.

20 Claims, 15 Drawing Sheets

(56) References Cited

U.S. PATENT DOCUMENTS

| | | | | |
|---|---|---|---|---|
| 2010/0236273 | A1* | 9/2010 | Kang | F25C 1/25 62/347 |
| 2013/0081412 | A1* | 4/2013 | Son | F25C 5/04 62/73 |
| 2020/0003470 | A1* | 1/2020 | Ishimizu | F25C 1/10 |

FOREIGN PATENT DOCUMENTS

| | | |
|---|---|---|
| JP | 2001-153512 | 6/2001 |
| KR | 101370250 | 3/2014 |
| KR | 10-2014-0088321 | 7/2014 |
| KR | 101850918 | 5/2018 |

OTHER PUBLICATIONS

Office Action in Korean Appln. No. 10-2018-0142125, mailed on Jul. 13, 2023, 11 pages (with English translation).
Notice of Allowance in Korean Appln. No. 10-2018-0142125, mailed on Mar. 21, 2024, 14 pages (with English translation).

* cited by examiner

ICE MAKER AND REFRIGERATOR HAVING THE SAME

CROSS REFERENCE TO RELATED APPLICATION

The present application is a continuation of U.S. application Ser. No. 16/685,675, filed on Nov. 15, 2019, which claims priority to Korean Patent Application No. 10-2018-0142125, filed on Nov. 16, 2018, the entire contents of which are incorporated herein by reference in their entirety.

BACKGROUND OF THE INVENTION

Field of the Invention

The present disclosure relates to an ice maker and a refrigerator having the ice maker.

Description of the Related Art

In general, a refrigerator is a home appliance that can keep food at a low temperature in a storage space that is closed by a door.

The refrigerator can keep stored food cold or frozen by cooling the inside of the storage space using cold air.

In general, an ice maker for making ice is disposed in refrigerators.

The ice maker is configured to make ice by keeping water, which is supplied from a water supply source or a water tank, in a tray.

Further, the ice maker is configured to be able to transfer the made ice from the ice tray in a heating type or a twisting type.

The ice maker that automatically receives water and transfers ice is formed to be open upward, thereby lifting up the formed ice.

The ice that is made by the ice maker having this structure has at least one flat side such as a crescent moon shape or a cubic shape.

Meanwhile, when ice is formed in a spherical shape, it may be more convenient to use the ice and it is possible to provide a different feeling of use to users. Further, when pieces of ice that have been made are stored, the contact areas of the pieces of ice are minimized, so it is possible to minimizing pieces of ice sticking to one another.

An ice maker has been disclosed in Korean Patent No. 10-1850918 that is a prior art document.

The ice maker of the prior art document includes: an upper tray having arrays of a plurality of upper cells having a semispherical shape, and having a pair of link guides extending upward from both side ends; a lower tray having arrays of a plurality of lower cells having a semispherical shape and rotatably connected to the upper tray; a rotary shaft connected to the rear ends of the lower tray and the upper tray such that the lower tray is rotated with respect to the upper tray; a pair of links having an end connected to the lower tray and the other end connected to the link guides; and an upper ejecting pin assembly having both ends, which are fitted in the link guides and respectively connected to the pair of links, and moving up/down with the links.

In the prior art document, a water supply tray that transmits water supplied from an external water supply source to an ice chamber is provided.

Further, the water supply tray is coupled to the upper tray by separate fasteners such as bolts.

Accordingly, there is a problem that the water supply tray is difficult to assemble and workability decreases.

Further, in the prior art document, there is a problem that while the upper tray is deformed to transfer ice, interference is generated between the lower end of the water supply tray and the water supply guide, whereby the upper end of the water supply guide presses the lower end of the water supply tray or the upper end of the water supply guide is inserted under the water supply tray.

SUMMARY OF THE INVENTION

The present disclosure provides an ice maker in which a water supply part can be easily coupled and separated, and a refrigerator having the ice maker.

Also, the present disclosure provides an ice maker in which a water supply part may be fixed to a vertical extension part when the water supply part is moved downward from an upper side, and the water supply part may be separated from the vertical extension part when the water supply part is moved upward from a lower side in a state in which the water supply part is coupled to the vertical extension part, and a refrigerator having the ice maker.

Also, the present disclosure provides an ice maker in which a coupling force of a water supply part and a vertical extension part is improved, and a refrigerator having the ice maker.

Also, the present disclosure provides an ice maker in which plastic deformation of an upper tray is prevented even though ice is repeatedly made, and a refrigerator having the ice maker.

Also, the present disclosure provides an ice maker in which deformation of an upper case and a lower case fixed with an upper tray is minimized, and a refrigerator having the ice maker.

In order to achieve the objects, a ice maker according to an aspect of the present disclosure includes: an upper assembly comprising a plurality of upper chambers formed to be recessed upward to define an upper portion of an ice chamber in which water is filled and ice is made, and having an intake opening by being open on a top, and a vertical extension part formed to protrude upward around the intake opening; a lower assembly comprising a plurality of lower chambers formed to be recessed downward to define a lower portion of the ice chamber, and rotatably connected to the upper assembly; and a water supply part having a container shape recessed downward from an upper side, having a fixing protrusions, which is fixed to the vertical extension part while moving downward from an upper side and is separated while moving upward from a lower side, on an outer surface, and coupled to the vertical extension part to transmit water, which is supplied from the outside, to the intake opening.

Also, a refrigerator according to another aspect of the present disclosure includes: a cabinet having a storage chamber; an ice maker disposed in the storage chamber and making ice by freezing water supplied to an ice chamber; and a water supply channel connected to an external water supply source and guiding water supplied from the water supply source to the ice chamber of the ice maker.

The ice maker includes: an upper assembly comprising a plurality of upper chambers formed to be recessed upward to define an upper portion of an ice chamber in which water is filled and ice is made, and having an intake opening by being open on a top, and a vertical extension part formed to protrude upward around the intake opening; a lower assembly comprising a plurality of lower chambers formed to be recessed downward to define a lower portion of the ice chamber, and rotatably connected to the upper assembly; and a water supply part having a container shape recessed downward from an upper side, having a fixing protrusions, which is fixed to the vertical extension part while moving downward from an upper side and is separated while moving upward from a lower side, on an outer surface, and coupled to the vertical extension part to transmit water, which is supplied from the outside, to the intake opening.

DETAILED DESCRIPTION OF THE INVENTION

Figure 1:
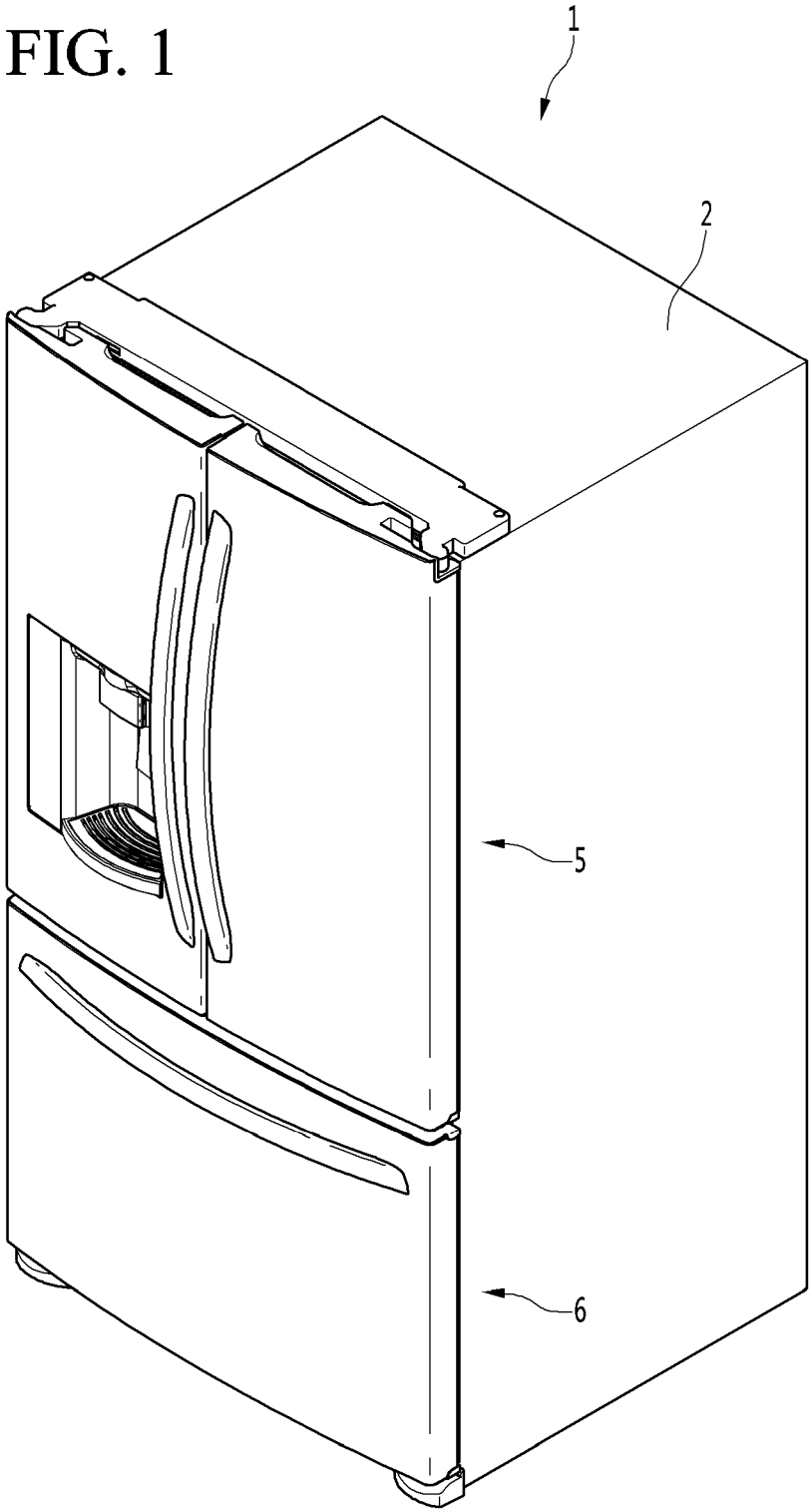
FIG. 1 is a perspective view of a refrigerator according to one embodiment of the present disclosure.
Figure 2:
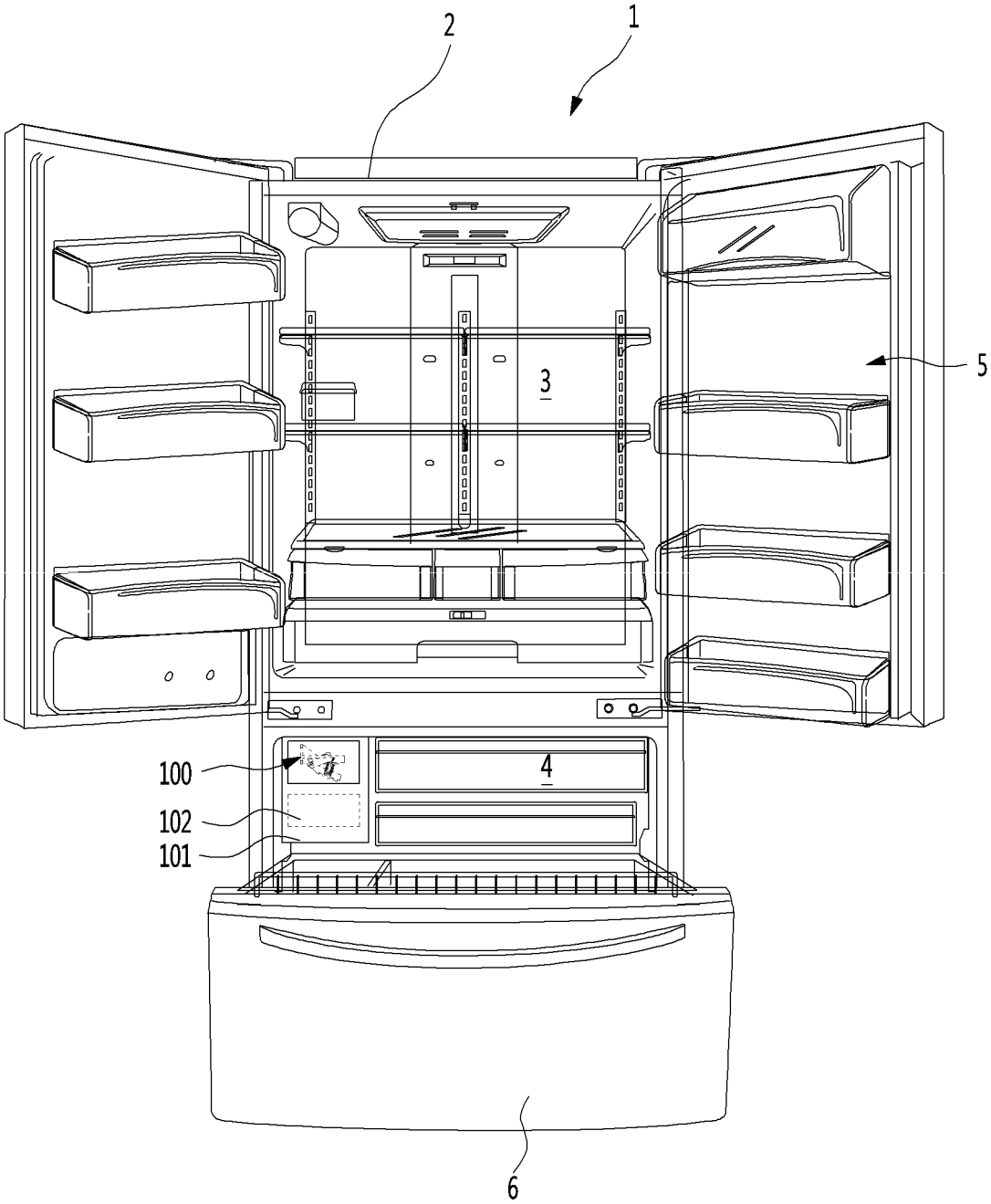
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the made ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

For another example, a dispenser 7 for dispensing purified water or the made ice to the outside may be provided in the refrigerating compartment door 5, Also, the ice made in the ice maker 100 or the ice stored in the ice bin 102 after being made in the ice maker 100 may be transferred to the dispenser 7 by a transfer unit. Thus, the user may obtain the ice from the dispenser 7.

Hereinafter, the ice maker will be described in detail with reference to the accompanying drawings.

Figure 3A:
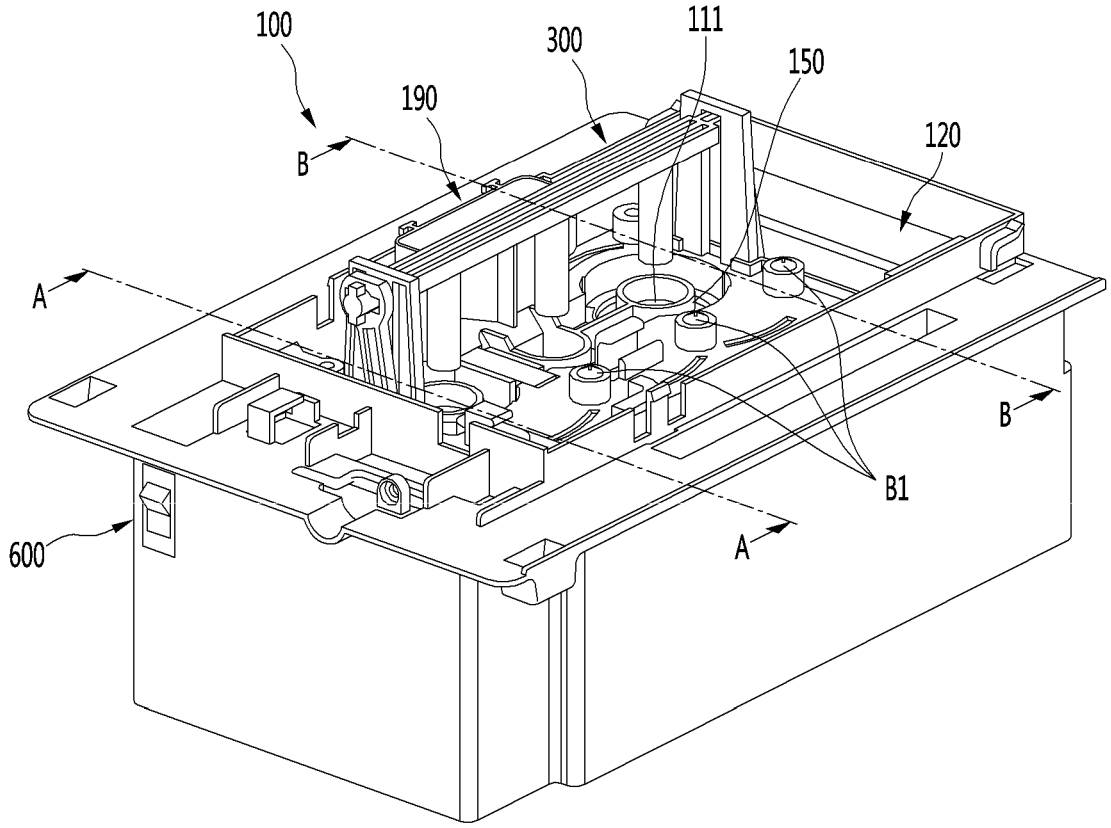
FIGS. 3A and 3B are perspective views of an ice maker according to one embodiment of the present disclosure.
Figure 3B:
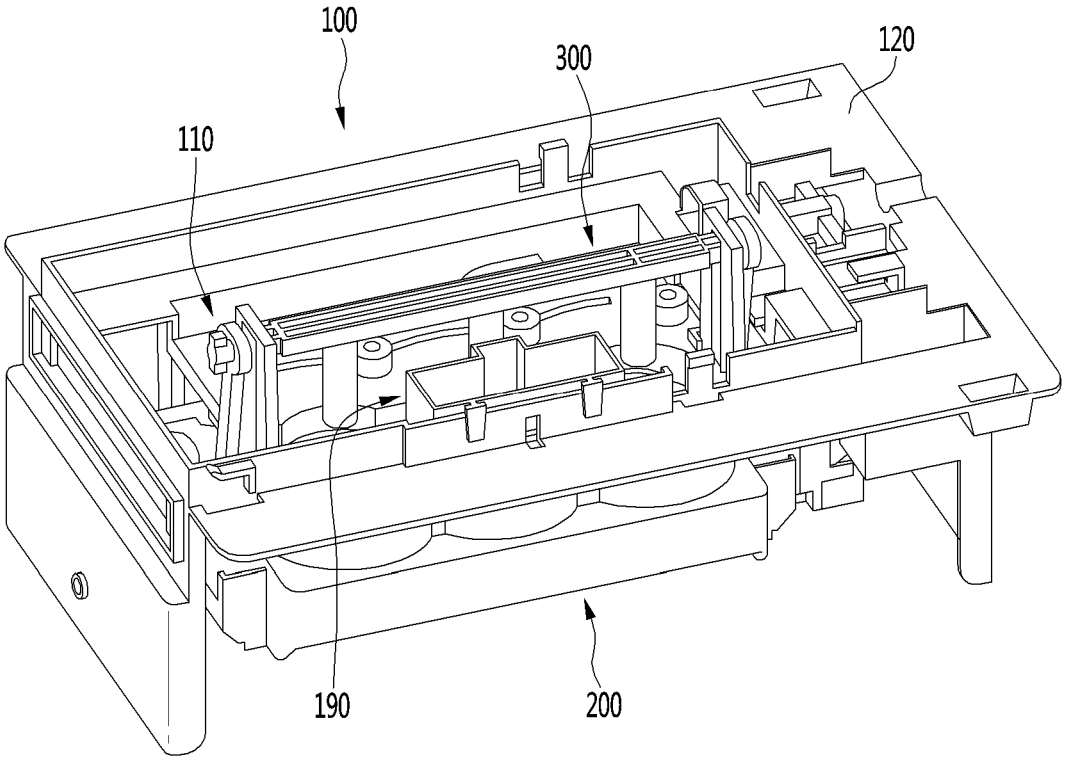
Figure 4:
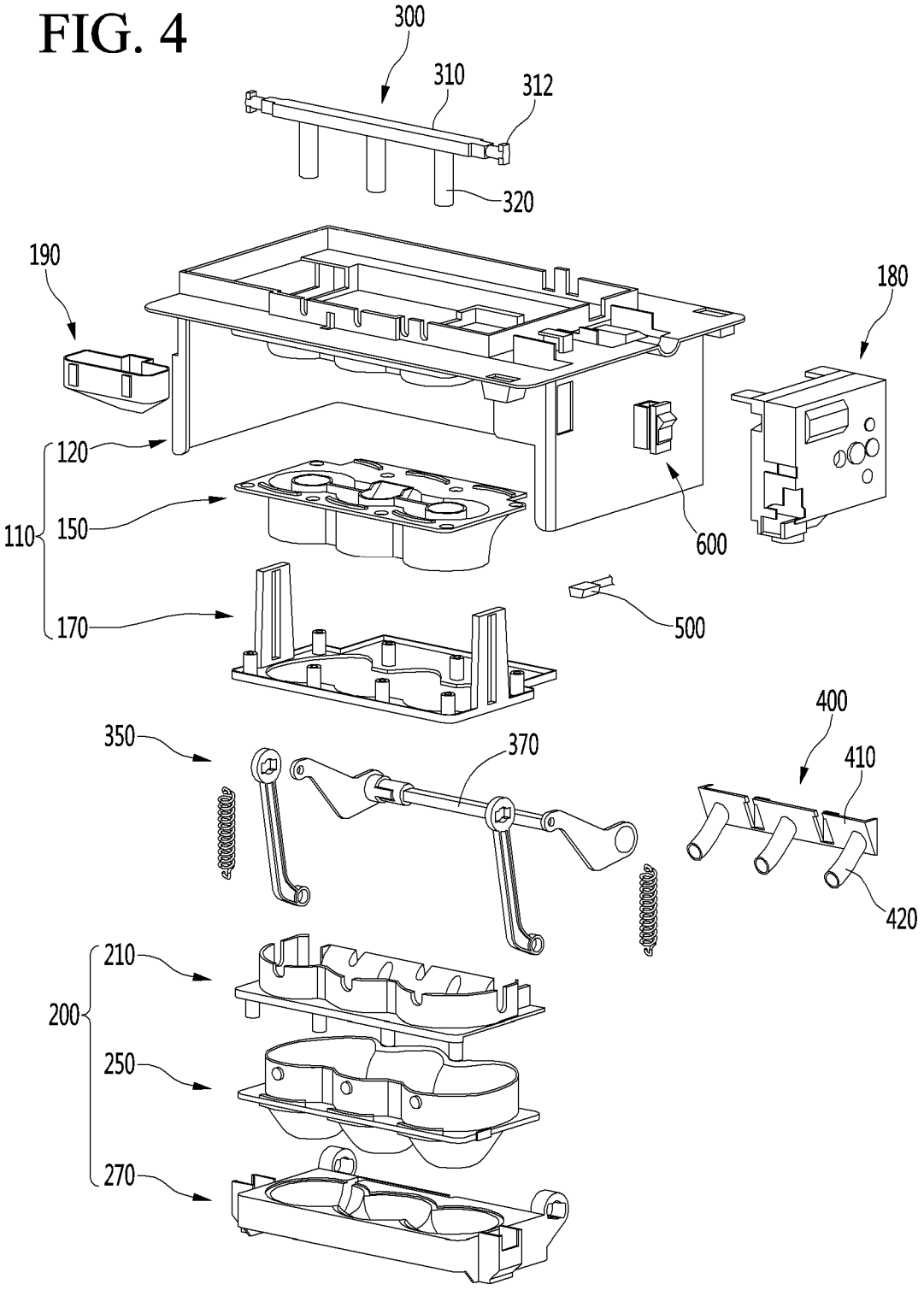
FIG. 4 is an exploded perspective view of the ice maker according to one embodiment of the present disclosure.

FIGS. 3A and 3B are perspective views of an ice maker according to one embodiment of the present disclosure and FIG. 4 is an exploded perspective view of the ice maker according to one embodiment of the present disclosure.

Referring to FIGS. 3A to 4, the ice maker 100 may include an upper assembly 110 and a lower assembly 200.

The lower assembly 200 may be rotatably connected to the upper assembly 110, When the lower assembly 200 has been rotated in one direction, it can made ice in cooperation with the upper assembly 110.

That is, the upper assembly 110 and the lower assembly 200 may define an ice chamber 111 for making the spherical ice. The ice chamber 111 may have a chamber having a substantially spherical shape.

The upper assembly 110 and the lower assembly 200 may define a plurality of ice chambers. Hereinafter, a structure in which three ice chambers are defined by the upper assembly 110 and the lower assembly 200 will be described as an example.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the spherical ice is made, the lower assembly 200 may rotate in another direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 is constructed so that the ice closely attached to the upper assembly 110 is separated from the upper assembly 110.

The upper ejector 300 may include an ejector body 310 and a plurality of upper ejector pins 320 extending in a direction crossing the ejector body 310.

The upper ejector pins 320 may be provided in the same number of ice chambers 111.

A separation prevention protrusion 312 for preventing a connection unit 350 from being separated in the state of being coupled to a connection unit 350 that will be described later may be provided on each of both ends of the ejector body 310.

For example, the pair of separation prevention protrusions 312 may protrude in opposite directions from the ejector body 310.

While the upper ejector pin 320 passing through the upper assembly 110 and inserted into the ice chamber 111, the ice within the ice chamber 111 is pressed.

The ice pressed by the upper ejector pin 320 may be separated from the upper assembly 110.

Also, the ice maker 100 may further include a lower ejector 400 so that the ice closely attached to the lower assembly 200 is capable of being separated. The lower ejector 400 presses the lower assembly 200 to separate the ice closely attached to the lower assembly 200 from the lower assembly 200.

For example, the lower ejector 400 may be fixed to the upper assembly 110. The lower ejector 400 may include an ejector body 410 and a lower ejecting pin 420 protruding from the ejector body 410. The lower ejecting pin 420 may be provided in the same number of ice chambers 111.

While the lower assembly 200 rotates to transfer the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejector 300 may descend by the connection unit 350 and press the ice. On the other hand, when the lower assembly 200 rotates in the other direction, the upper ejector 300 may ascend by the connection unit 350 to return to its original position.

Hereinafter, the upper assembly and the lower assembly will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper case 120 and an upper support 170 for fixing a position of the upper tray 150.

The upper tray 150 may be disposed below the upper case 120. A portion of the upper support 170 may be disposed below the upper tray 150.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

Further, the upper supporter 170 may restrict downward movement of the upper tray 150 by supporting the lower portion of the upper tray 150.

For example, the water supply part 190 may be fixed to the upper case 120.

The ice maker 100 may further include a temperature sensor 500 detecting a temperature of the upper tray 150.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250 and a lower case 210 restricting deformation of the upper portion of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice. That is, a series of processes in which when the switch 600 is turned on, water is supplied to the ice maker 100, and when ice is made by cold air, the lower assembly 200 is rotated and transfers the ice may be repeatedly performed.

On the other hand, when the switch 600 is manipulated to be turned off, the making of the ice through the ice maker 100 may be impossible. The switch 600 may be provided in the upper case 120.

<Upper Case>

Figure 5:
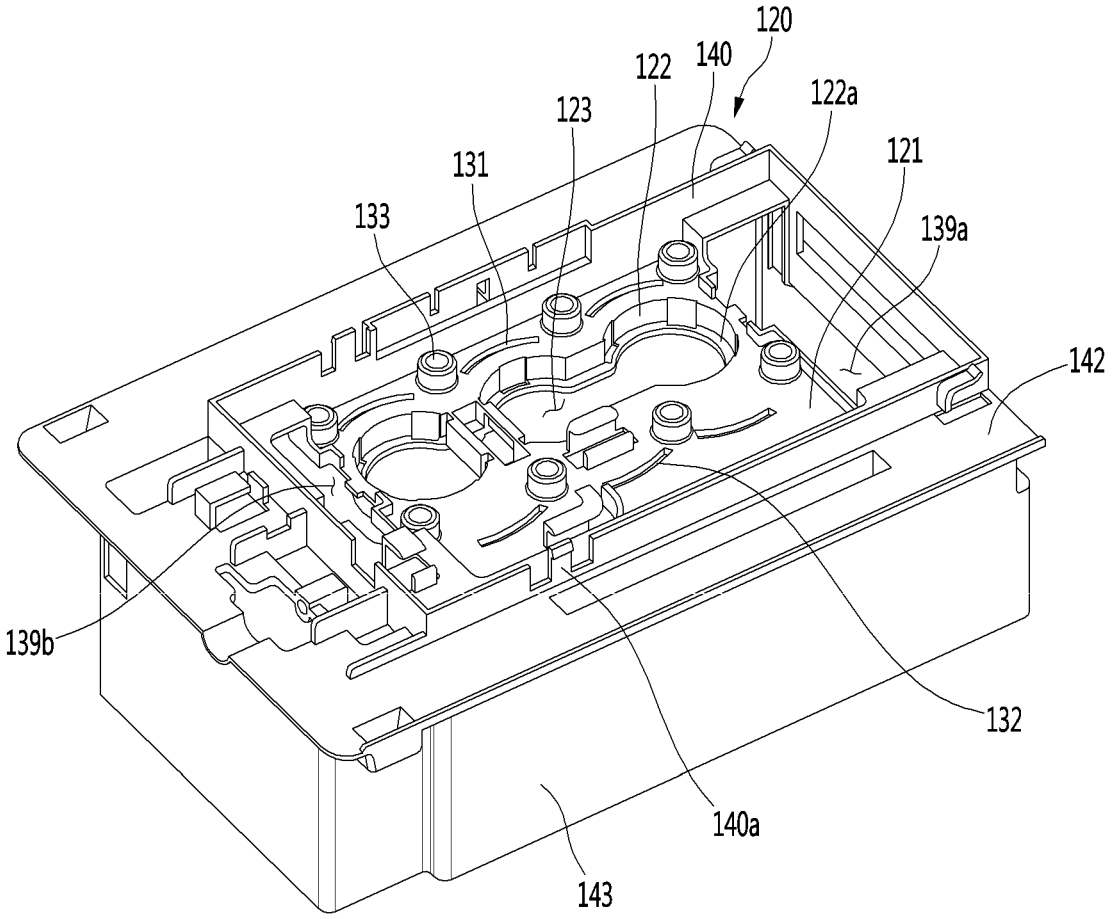
FIG. 5 is an upper perspective view of an upper case according to one embodiment of the present disclosure.

FIG. 5 is an upper perspective view of an upper case according to one embodiment of the present disclosure. Also, FIG. 6 is a lower perspective view of the upper case according to one embodiment of the present disclosure.

Figure 6:
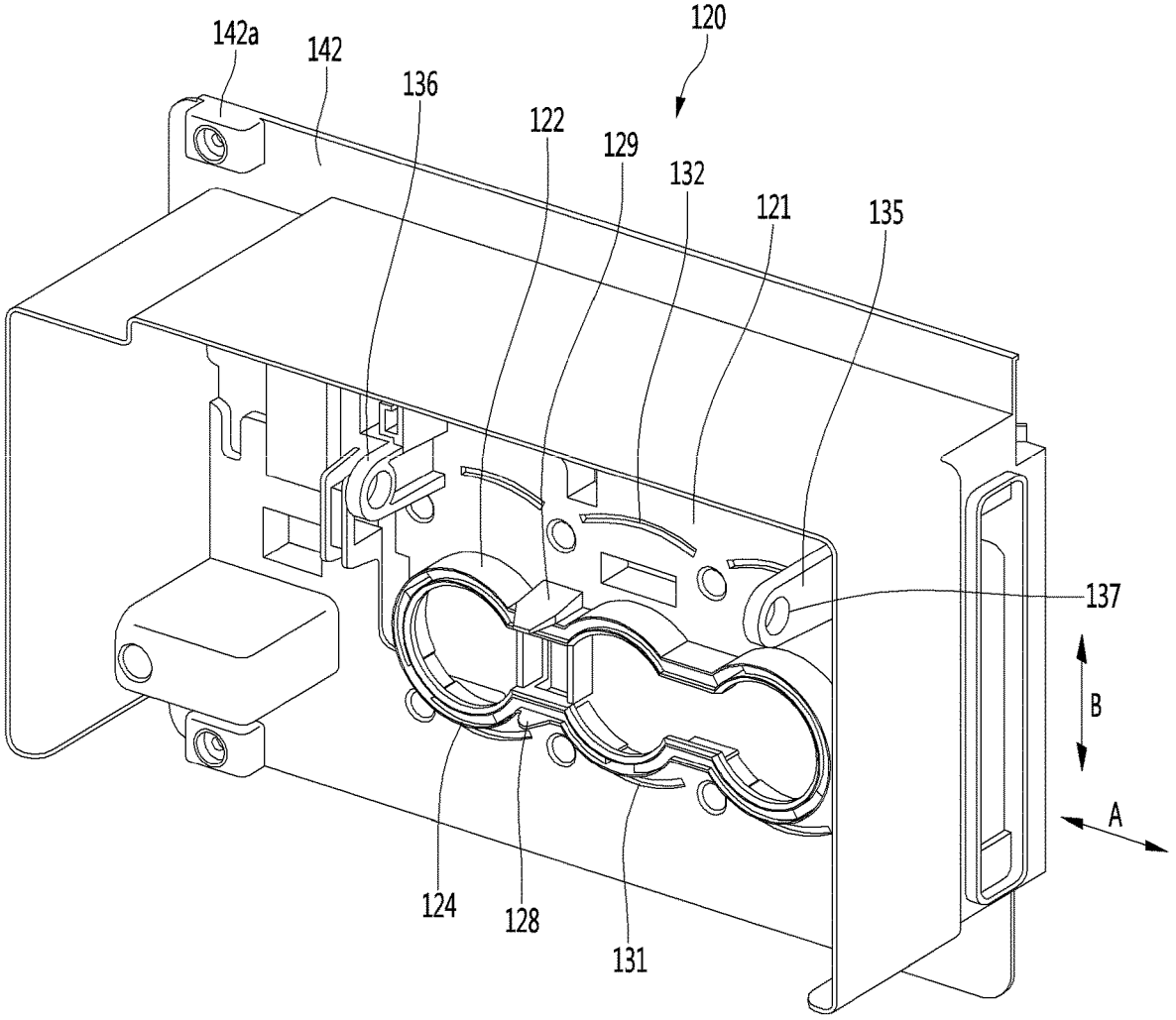
FIG. 6 is a lower perspective view of the upper case according to one embodiment of the present disclosure.

Referring to FIGS. 5 and 6, the upper case 120 may be fixed to a housing 101 within the freezing compartment 4 in a state in which the upper tray 150 is fixed.

The upper case 120 may include an upper plate 121 for fixing the upper tray 150.

The upper tray 150 may be fixed to the upper plate 121 with a portion thereof in contact with a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a recess 122 that is recessed downward. The opening 123 may be defined in a bottom surface 122*a* of the recess 122.

Thus, the upper tray 150 passing through the opening 123 may be disposed in a space defined by the recess 122.

A heater coupling part 124 for coupling an upper heater (see reference numeral 148 of FIG. 13) that heats the upper tray 150 so as to transfer the ice may be provided in the upper case 120

For example, the heater coupling part 124 may be provided on the upper plate 121. The heater coupling part 124 may be disposed below the recess 122.

The upper case 120 may include a plurality of installation ribs 128 and 129 for installing the temperature sensor 500.

The pair of installation ribs 128 and 129 may be disposed to be spaced apart from each other in a direction of an arrow B of FIG. 6. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 120.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

For example, the opening 123 may be defined between the first upper slot 131 and the second upper slot 132.

The first upper slot 131 and the second upper slot 132 may be spaced apart from each other in a direction of an arrow B of FIG. 6.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of an arrow A.

For example, the first upper slot 131 may be defined in a curved shape. Thus, the first upper slot 131 may increase in length.

For example, the second upper slot 131 may be defined in a curved shape. Thus, the second upper slot 133 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the second upper slot 132 and the opening 123 may be shorter than a distance between the first upper slot 131 and the opening 123.

Also, when viewed from the opening 123 toward each of the upper slots 131, a shape that is convexly rounded from each of the slots 131 toward the outside of the opening 123 may be provided.

The upper plate 121 may include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may include a plurality of hinge supports 135 and 136 allowing the lower assembly 200 to rotate.

The plurality of hinge supports 135 and 136 may be disposed to be spaced apart from each other in the direction of the arrow A with respect to FIG. 7. Also, a first hinge hole 137 may be defined in each of the hinge supports 135 and 136.

For example, the plurality of hinge supports 135 and 136 may extend downward from the upper plate 121.

The upper case 120 may further include a vertical extension part 140 vertically extending along a circumference of the upper plate 121.

The vertical extension part 140 may include one or more coupling hooks 140*a*. The upper case 120 may be hook-coupled to the housing 101 by the coupling hooks 140*a*.

The upper case 120 may further include a horizontal extension part 142 horizontally extending to the outside of the vertical extension part 140.

A screw coupling part 142*a* protruding outward to screw-couple the upper case 120 to the housing 100 may be provided on the horizontal extension part 142.

The upper case 120 may further include a side circumferential part 143 extending downward from the horizontal extension part 142. The side circumferential part 143 may be disposed to surround a circumference of the lower assembly 200. That is, the side circumferential part 143 may prevent the lower assembly 200 from being exposed to the outside.

Although the upper case is coupled to the separate housing 101 within the freezing compartment 4 as described above, the embodiment is not limited thereto. For example, the upper case 120 may be directly coupled to a wall defining the freezing compartment 4.

<Water Supply Part>

Meanwhile, the present disclosure includes a water supply channel (not shown) that is connected to an external water supply source and guides water supplied from the water supply source to the ice chamber 111 of the ice maker 100.

Also, water discharged from the water supply channel (not shown) may be supplied to the ice chamber 111 through a separate water supply part 190 that functions as a funnel.

As described above, the ice maker 100 includes the upper assembly 110 and the lower assembly 200.

Also, the upper assembly 110 includes the upper case 120 and the upper tray 150.

The upper tray 150 include a plurality of upper chambers 151 recessed upward to define the upper portion of the ice chamber 111. Also, the upper chambers 151 are open at the upper portion, thereby forming an intake opening 154.

The upper case 120 further includes a vertical extension part 140 forming a wall by vertically extending along a circumference of the upper plate 121.

The lower assembly 200 includes the lower case 210 and the lower tray 250.

Also, the lower tray 250 includes a plurality of lower chambers 252 recessed downward to define the lower portion of the ice chamber 111.

Also, the lower tray 250 is rotatably connected to the upper assembly 110.

Hereafter, the water supply part 190 is described with reference to the drawings.

Figure 7A:
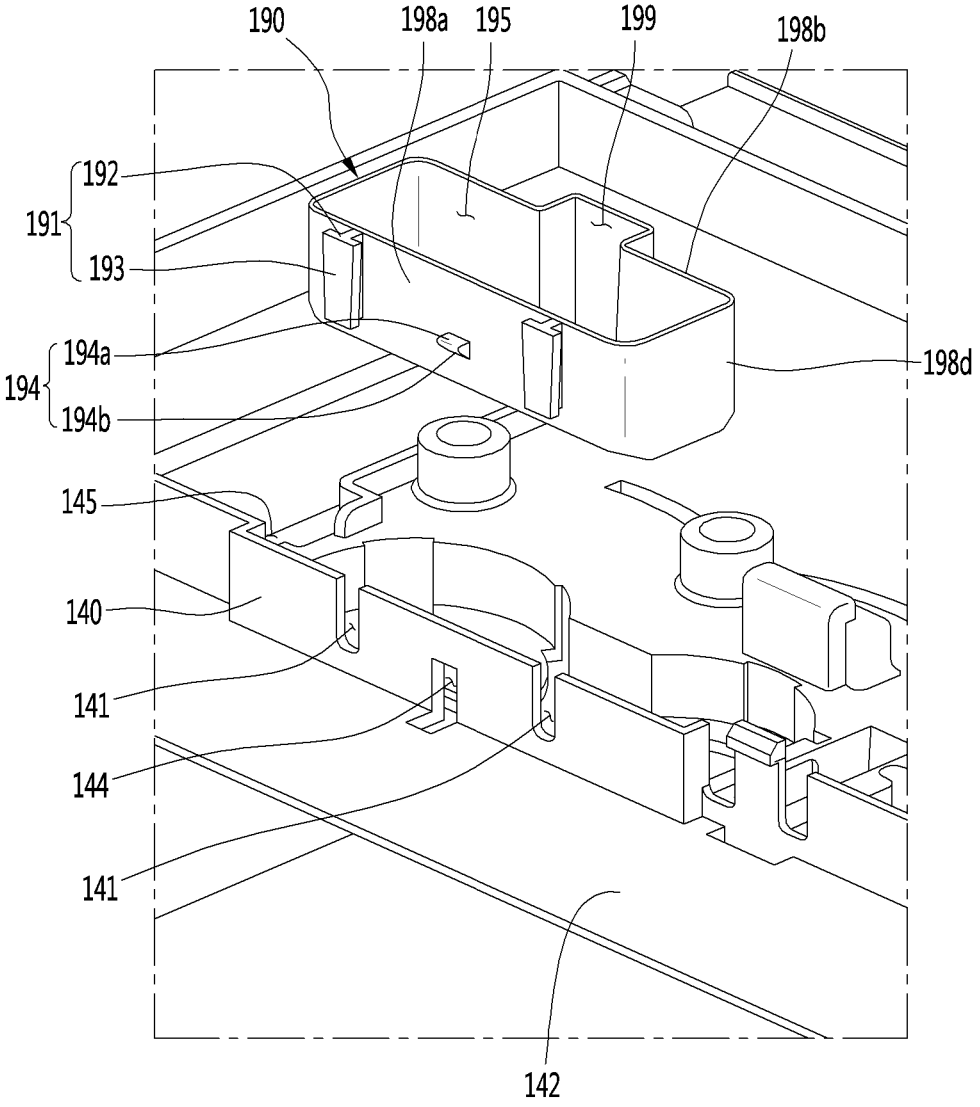
FIG. 7A is a perspective view showing in one direction a state in which the upper case and a water supply are separated.
Figure 7B:
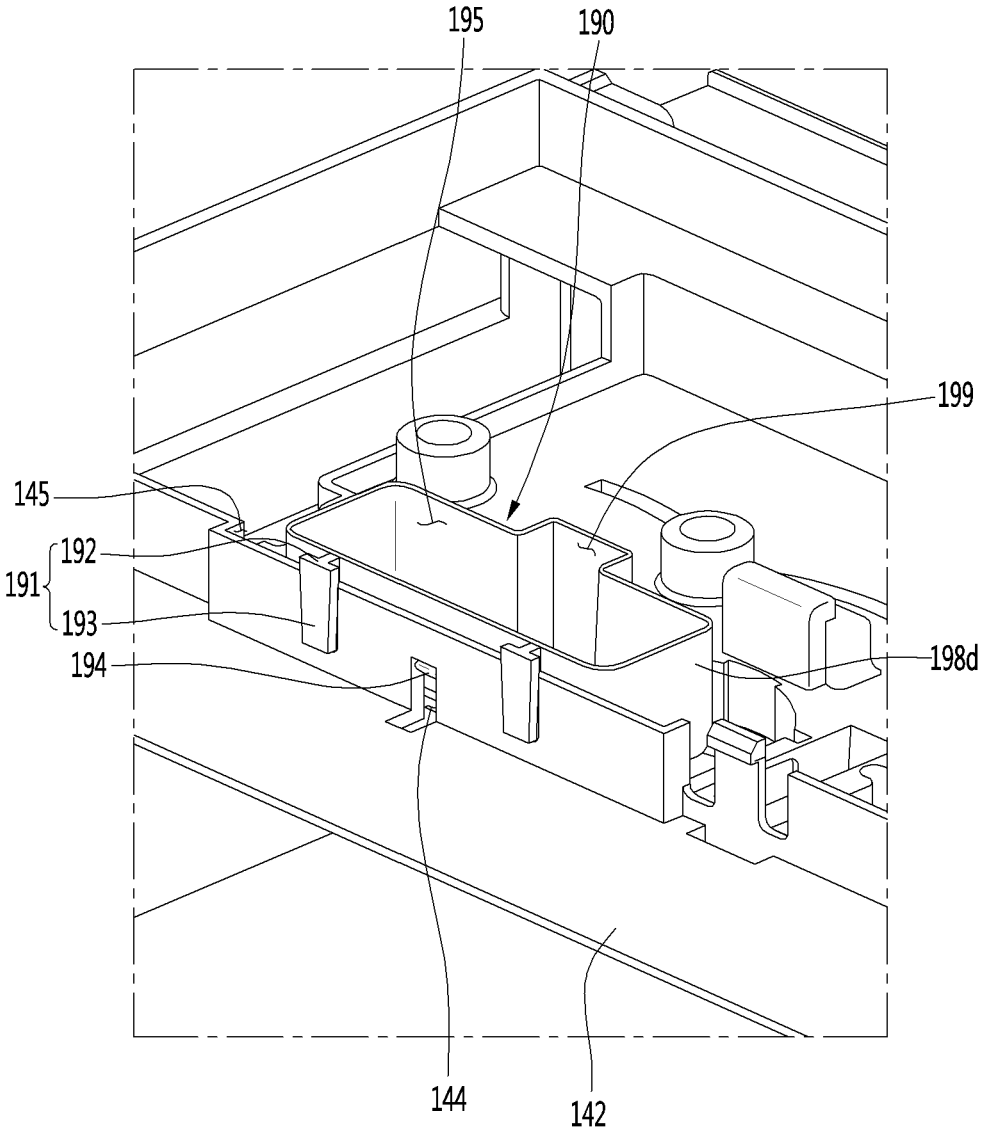
FIG. 7B is a perspective view showing in one direction a state in which the upper case and the water supply part are combined.

FIG. 7A is a perspective view showing in one direction a state in which the upper case and the water supply part are separated. FIG. 7B is a perspective view showing in one direction a state in which the upper case and the water supply part are combined.

Referring to FIGS. 7A and &B, the water supply part 190 is coupled to the upper case 120.

The water supply part 190 is coupled to the vertical extension part 140 formed on the upper case 120 and transmits water supplied from the water supply channel (not shown) to the intake opening 154. The water supplied to the intake opening 154 flows into the ice chamber 111 defined by the upper chamber 151 and the lower chamber 252 and is then made into ice.

The water supply part 190 may have a container shape recessed downward from the upper side.

The water supply part 190 forms an inlet 195 by being open on the top and is formed such that a bottom surface 196 is inclined, and an outlet 197 may be formed at the lowermost end of the bottom surface 196. The outlet 197 is disposed over the intake opening 154.

Thus, water flowing inside through the inlet 195 may flow to collect downward through the inclined bottom surface 196, may be discharged only to the outlet 197 formed at the lowermost end of the bottom surface 196, and then may be supplied to the intake opening 154.

The water supply part 190 may be formed such that the upper portion where the inlet 195 is formed is wide and the lower portion where the outlet 197 is formed is narrow.

Accordingly, it is easy to be supplied with water from the water supply channel through the wide inlet 195. Also, water may be intensively discharged through the narrow outlet 197 and water may be supplied only to the intake opening 154 without spilling around the intake opening 154.

The water supply part 190 may be coupled to the vertical extension part 140 in various well-known methods.

A fixing protrusion 191 that is fixed to the vertical extension part 140 when moving downward from the upper side and that is separated when moving upward from the lower side may be formed on the outer surface of the water supply part 190. The fixing protrusion 191 may protrude toward the vertical extension part 140 from the outer surface (the surface facing the vertical extension part) of the water supply part 190. The fixing protrusion 191 may have a bar shape that is long in the up-down direction.

The fixing protrusion 191 may be coupled to the vertical extension part 140 in various manners.

For example, a fixing slit 141 having a shape concavely cut downward from the upper end may be formed at the vertical extension part 140. Also, the fixing protrusion 191 may be fitted in the fixing slit 141.

At this time, when the fixing protrusion 191 is positioned over the fixing slit 141 and the water supply part 190 is moved down from above the vertical extension part 140, the fixing protrusion 191 is inserted into the fixing slit 141, whereby the water supply part 190 may be coupled to the vertical extension part 140.

On the contrary, when the fixing protrusion 191 is pulled out of the fixing slit 141 by lifting up the water supply part 190 in a state in which the water supply part 190 is coupled to the vertical extension part 140, as described above, the water supply part 190 may be separated from the vertical extension part 140.

For another example, the fixing protrusion 191 may be formed in a clip shape extending and bending downward from the upper portion of the water supply part 190 and may be coupled to the vertical extension part 140 in a manner of holding downward the vertical extension part 140 from the upper side. In this case, the slit may not be formed at the vertical extension part 140.

According to the present disclosure described above, when the water supply part 190 is moved downward from the upper side with respect to the vertical extension part 140, the water supply part 190 is fixed to the vertical extension part 140. Also, the water supply part 190 may be separated from the vertical extension part 140 by moving up the water supply part 190 from the lower side in a state in which the water supply part 190 is coupled to the vertical extension part 140. Thus, the water supply part 190 may be easily coupled and separated.

Meanwhile, a plurality of fixing slits 141 may be formed and spaced apart from each other and a plurality of fixing protrusions 191 may also be formed to correspond to the fixing slits 141.

As described above, when pluralities of fixing slits 141 and fixing protrusions 191 are formed, the fixing protrusions 191 are fitted in the fixing slits 141 at corresponding positions, whereby the coupling force between the water supply part 190 and the vertical extension part 140 may be further improved.

In the drawings, although the case in which the fixing slits 141 and the fixing protrusions 191 are each provided in pair is shown, the fixing slits 141 and the fixing protrusions 191 each may be provided as three or more pieces.

Also, the fixing protrusion 191 may include: an insertion part 192 that extends from the outer surface (surface facing the vertical extension part) of the water supply part 190, is formed with a width smaller than the width of the fixing slit 141 or the same as the width of the fixing slit 141, and is inserted in the fixing slit 141; an expansion part 193 that is formed with a width larger than the insertion part 192 and the fixing slit 141 and is disposed outside the vertical extension part 140 when the insertion part 192 is inserted in the fixing slit 141.

That is, the insertion portion 192 passes through the fixing slit 141, the water supply part 190 is disposed inside the vertical extension part 140 (in the direction in which the intake opening is formed), and the expansion part 193 is disposed outside the vertical extension part 141.

Thus, when the fixing protrusion 191 is fitted in the fixing slit 141, horizontal movement of the water supply part 190 (in the direction parallel with the insertion part) may be restricted by the expansion part 193. That is, horizontal fixing force for the water supply part 190 may be secured by the configuration of the expansion part 193.

Also, at least any one of the fixing slit 141 or the fixing protrusion 191 may have a shape that becomes gradually thin downward from the upper side.

As described above, when the fixing slit 141 or the fixing protrusion 191 has a shape that becomes gradually thin downward from the upper side, the fixing protrusion 191 may be more easily fitted downward into the fixing slit 141 from above the fixing slit 141.

Also, when the fixing protrusion 191 is fitted in the fixing slit 141, the lower portion of the fixing protrusion 191 may be more securely fixed to the lower portion of the fixing slit 141.

Also, when vertical extension part 140 has an oblong fixing hole 144, which is open in the up-down direction, at the lower portion, and a fixing hook 194 that is formed to protrude outward and is coupled by being inserted in the fixing hole 144 may be formed on the outer surface of the water supply part 190.

The fixing hole 144 may be formed between a pair of fixing slits 141 formed at both sides of the vertical extension part 140. Also, the fixing hook 194 may be formed between a pair of fixing protrusions 190 formed at both sides of the water supply part 19.0.

The protrusive thickness of the fixing hook 194 may be larger than the gap between the vertical extension part 140 and the water supply part 190 in a state in which the water supply part 190 is coupled to the vertical extension part 140. Also, when the water supply part 190 is coupled to the vertical extension part 140, the fixing hook 194 may be inserted into the fixing hole 144 in a forcible fitting manner.

For example, the fixing hook 194 may be formed such that the thickness gradually decreases downward from the upper side, whereby a flat surface 194 may be formed at the upper portion and a first inclined surface 194*b* may be formed on side facing the vertical extension part 140.

When the fixing hook 194 is formed, as described above, the fixing hook 194 moves downward in contact with the inner surface (surface facing the water supply part) of the vertical extension part 140 along the first inclined surface 194*b* when the fixing protrusion 191 is inserted into the fixing slit 141.

Also, when the fixing protrusion 191 is fully inserted in the fixing slit 141, the fixing hook 194 is inserted in the fixing hole 144 and the flat surface 194*a* is locked to the upper end of the fixing hole 144.

According to the present disclosure, in a state in which the fixing protrusion 191 is fully inserted in the fixing slit 141, the fixing hook 194 is inserted in the fixing hole 144, whereby up/down movement of the water supply part 190 may be restricted. That is, the coupling force of the water supply part 190 and the vertical extension part 140 may be further improved.

Meanwhile, the vertical extension part 140 has a first cavity 145 recessed from a side where the water supply part 190 is disposed to the other side on the inner surface (surface facing the water supply part).

As the first cavity 145 is formed, as described above, the outer surface of the vertical extension part 140 may protrudes from a side to the other side.

The shape of the first cavity 145 may correspond to the shape of a side of the water supply part 190. Also, a side of the water supply part 190 may be accommodated in the first cavity 145.

As described above, when a side of the water supply part 190 is accommodated in the first cavity 145, the water supply part 190 may be more stably coupled to the vertical extension part 140. Also, spatial usability may also be improved.

Figure 8:
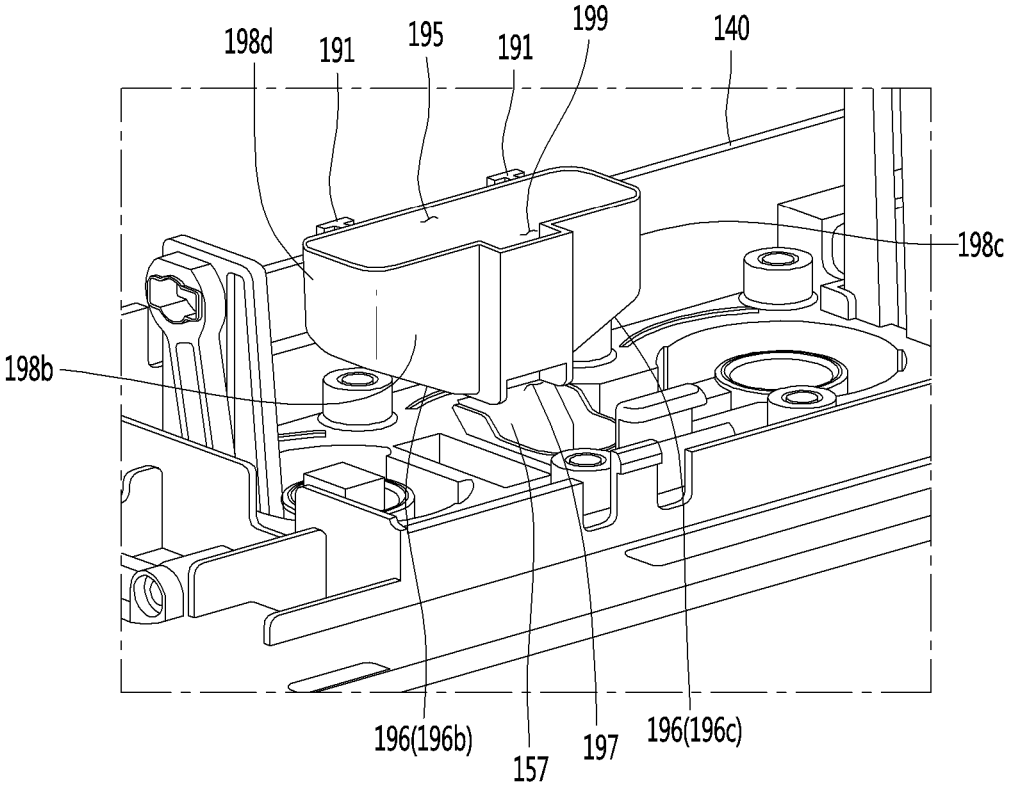
FIG. 8 is a perspective view showing in another direction a state in which the upper case and the water supply part are combined.
Figure 9:
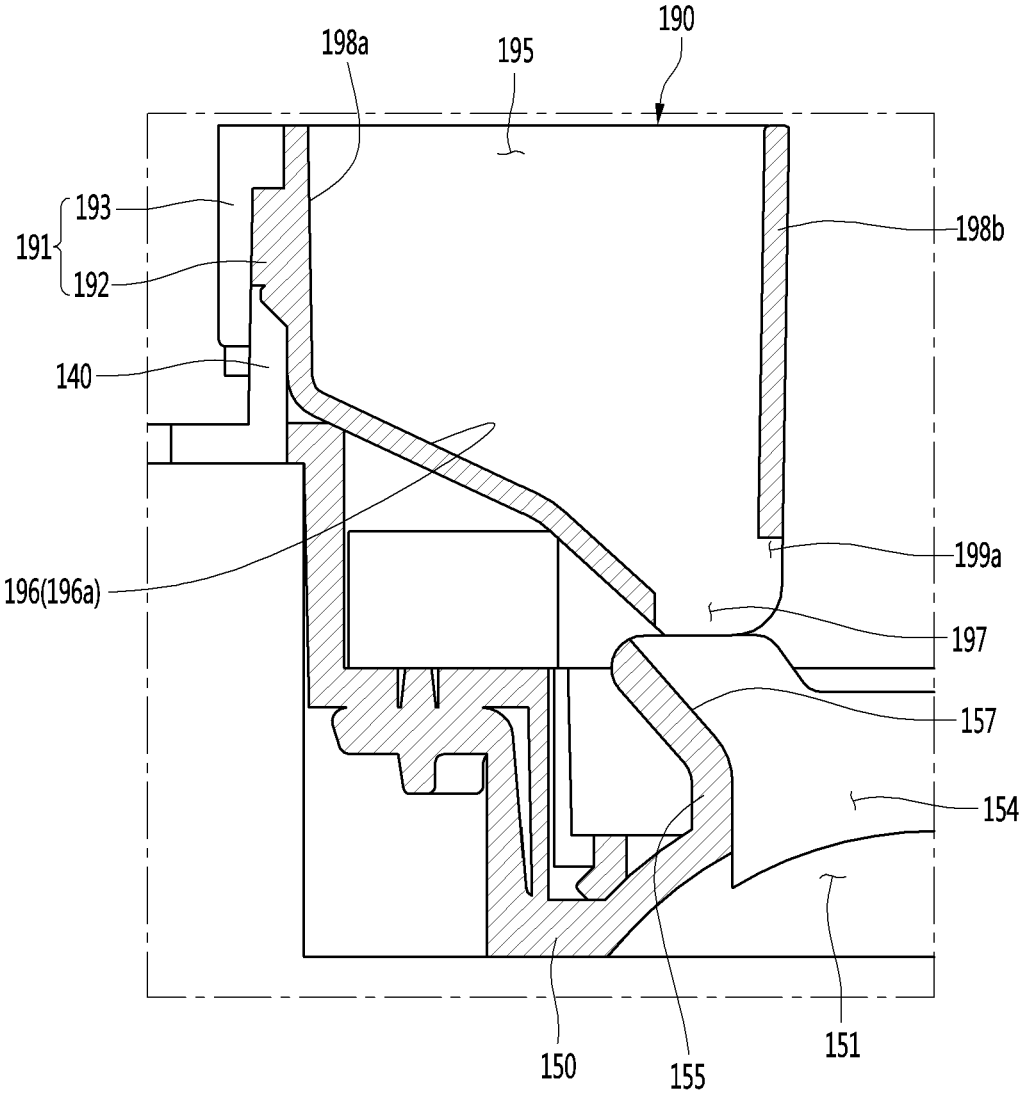
FIG. 9 is a view showing a cross-section of the water supply part and the upper case in a state in which the upper case and the water supply part are combined.
Figure 10:
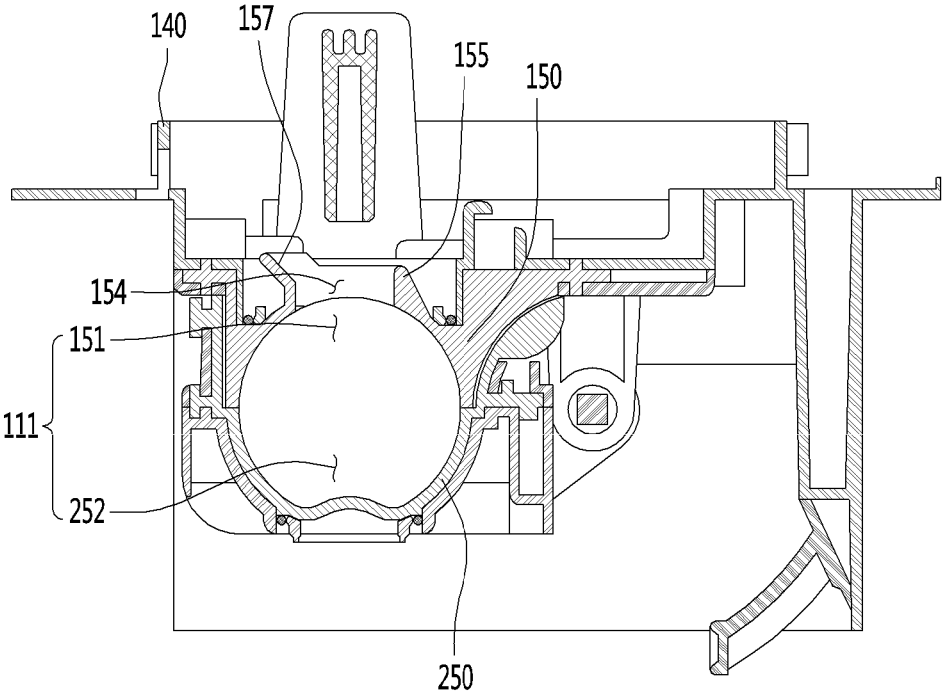
FIG. 10 is a cross-sectional view showing a state in which the upper case and a lower case that are combined.
Figure 11:
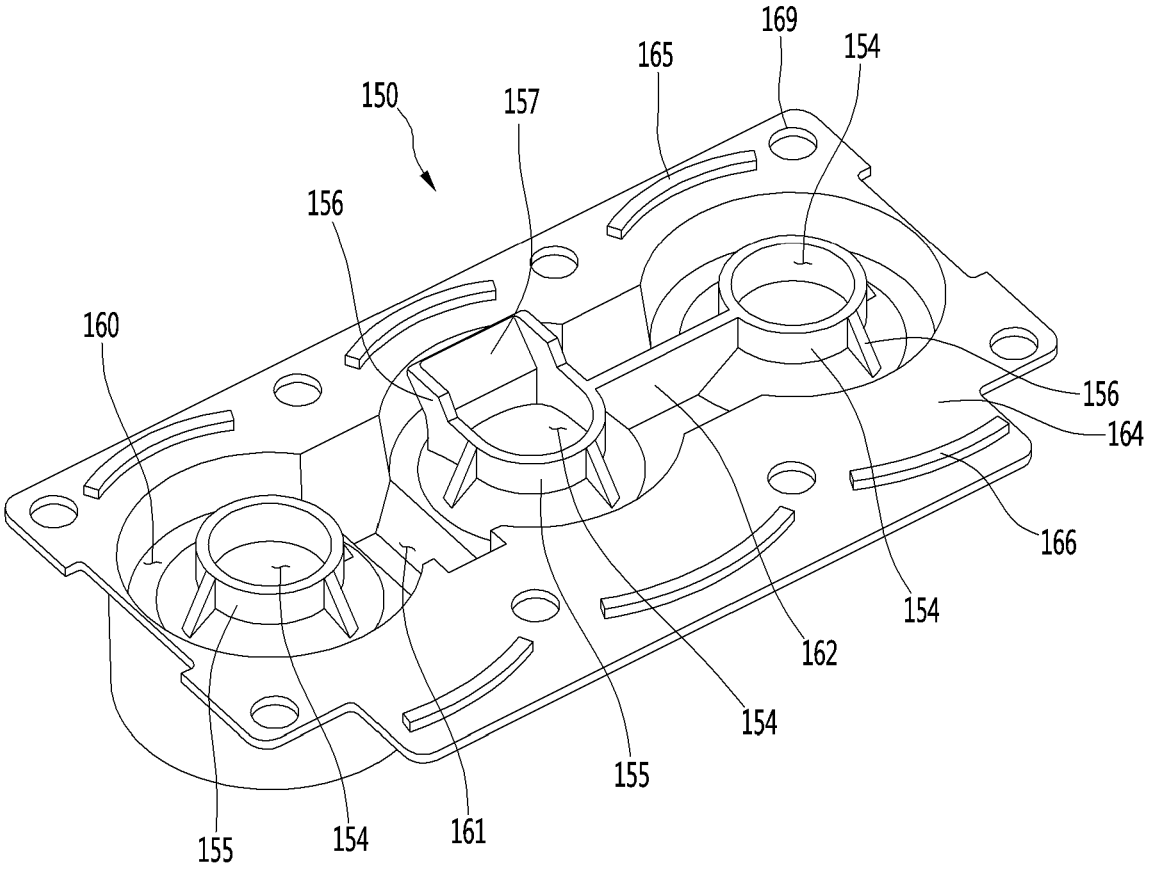
FIG. 11 is a perspective view of the upper case.

FIG. 8 is a perspective view showing in another direction a state in which the upper case and the water supply part are combined. Also, FIG. 9 is a view showing a cross-section of the water supply part and the upper case in a state in which the upper case and the water supply part are combined. FIG. 10 is a cross-sectional view showing a state in which the upper case and the lower case that are combined. Also, FIG. 11 is a perspective view of the upper case.

Referring to FIGS. 8 to 11, the upper tray 150 has an inlet wall 155 extending upward around the circumference of the intake opening 154.

For example, the inlet wall 155 may be formed in a cylindrical shape. Thus, water discharged from the water supply part 190 may flow into the intake opening 154 through the internal space of the inlet wall 155.

Also, the lower end of the outlet 197 may be formed at the same height as that of the upper end of the inlet wall 155 or may be positioned higher than the inlet wall 155.

For example, the upper tray 150 may be made of silicone that can elastically deform, etc. In this case, the upper tray 150 may deform in the process of transferring ice. At this time, the upper end of the inlet wall 155 that corresponds to the uppermost end of the upper tray 150 may push up the water supply part 190 or may be inserted into the water supply part 190. That is, when the upper tray 150 transfers ice, interference may be generated between the upper end of the inlet wall 155 and the outlet 197.

Accordingly, by forming the upper end of the inlet wall 155 at the same height as the lower end of the outlet 197 or positioning the upper end of the inlet wall 155 lower than the lower end of the outlet 197, it is possible to remove interference that is generated between the upper end of the inlet wall 155 and the outlet 197 when the upper tray 150 is deformed.

Also, the inlet wall 155 may have a second inclined surface 157 inclined to correspond to the bottom surface 196 on a side.

When the second inclined surface 157 is formed on the inlet wall 155, as described above, water flowing along the bottom surface 196 of the water supply part 190 and then discharged to the outlet 197 can easily flow into the intake opening 154 along the second inclined surface 157. Also, even though the outlet 197 and the upper end of the inlet wall 155 are spaced apart from each other, the water flowing along the bottom surface 196 of the water supply part 190 can stably flow into the intake opening 154 along the second inclined surface 157.

Also, the water supply part 190 may include side walls. In detail, the side walls may include a first side wall 198*a* and a second side wall 198*b* that are formed in parallel with the vertical extension part 140, and a third side wall 198*c* and a fourth side wall 198*d* that connect both sides of the first side wall 198*a* and the second side wall 198*b*.

Also, the bottom surface 196 of the water supply part 190 may include a first inclined part 196*a* formed to be inclined downward toward the second side wall 198*b* from the lower end of the first side wall 198*a* facing the vertical extension part 140, and a second inclined part 196*b* and a third inclined part 196*c* formed to be inclined downward toward the center portion from the lower end of the third side wall 198*c* and the lower end of the fourth side wall 198*d*.

Accordingly, water flowing in the water supply part 190 is collected to one place by the first inclined part 196*a*, the second inclined part 196*b*, and the third inclined part 196*c*, and is discharged to only one place in the collected state, whereby the water may be supplied to the intake opening 154.

Also, a second cavity 199 having an outer surface (surface facing the intake opening) protruding outward and having an inner surface recessed outward may be formed on the second side wall 198*b*.

Also, the outlet 197 is formed by opening the lower portion of the second cavity 199, and a surface of the second cavity 199 has a cut portion recessed upward to communicate with the outlet 197 at a lower end.

When the second cavity 199 is formed, as described above, the outlet 197 may be formed close to the intake opening 154. Accordingly, water flowing in the water supply part 190 may be maximally discharged to the center portion of the intake opening 154.

Hereafter, a process of preparing for supplying water and making ice by the ice maker according to an embodiment of the present disclosure is described.

Figure 12:
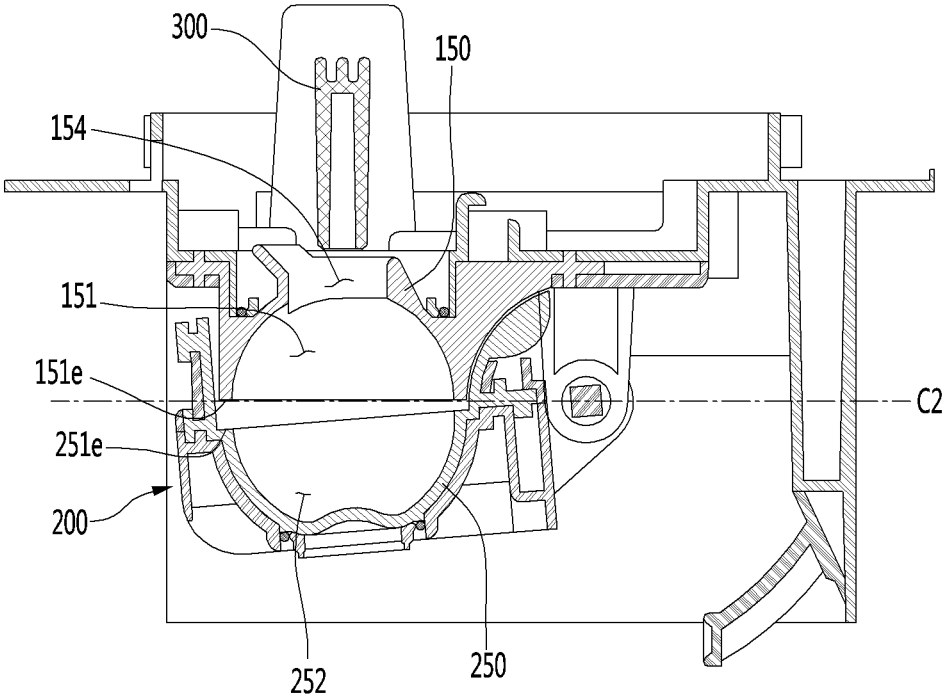
FIG. 12 is a cross-sectional view taken along line B-B of FIG. 3 in a water supply state.
Figure 13:
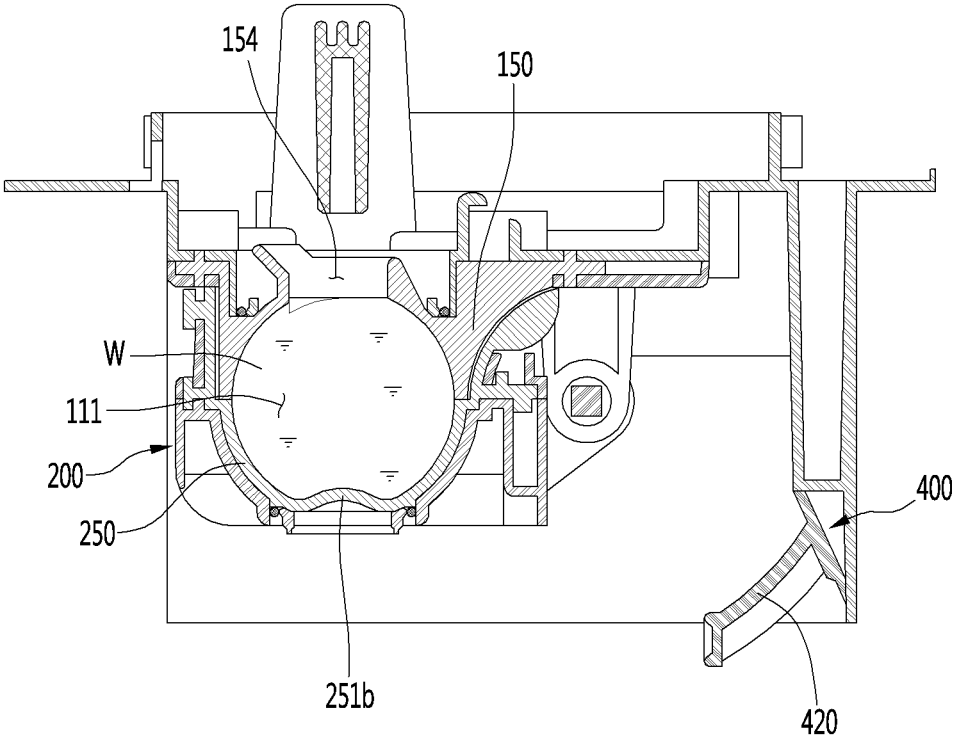
FIG. 13 is a cross-sectional view taken along line B-B of FIG. 3 in an ice making state.

FIG. 12 is a cross-sectional view taken along line B-B of FIG. 3 in a water supply state and FIG. 13 is a cross-sectional view taken along line B-B of FIG. 3 in an ice making state.

Referring to FIG. 12, first, the lower assembly 200 rotates to a water supply standby position The top surface 251*e* of the lower tray 250 is spaced apart from the bottom surface 151*e* of the upper tray 150 at the water supply standby position of the lower assembly 200.

Although not limited, the bottom surface 151*e* of the upper tray 150 may be disposed at a height that is equal or similar to a rotational center C2 of the lower assembly 200 In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply standby position of the lower assembly 200 may be about 8 degrees.

In this state, the water supplied through a water supply channel from the outside flows into the water supply part 190.

Also, the water flowing in the water supply part 190 is supplied to the intake opening 154. The ice chamber 111 is filled with the water supplied to the intake opening 154 to make ice.

At this time, water may be supplied to the ice chamber 111 through one intake opening of a plurality of intake openings 154 of the upper tray 150.

In a state in which water supply is finished, some of the water may fully fill the lower chamber 252 and another some of the water may fill between the upper tray 150 and the lower tray 250.

Another some of the water may fill the upper chamber 151. Obviously, water may not be positioned in the upper chamber 152 after water supply is finished, depending on the angle between the top surface 251*e* of the lower tray 250 and the bottom surface 151*e* of the upper tray 150 or the volumes of the lower chamber and the upper chamber.

In case of this embodiment, a channel for communication between the three lower chambers may not be provided in the lower tray 250.

As described above, although the channel is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

Meanwhile, in the state in which the supply of the water is completed, as illustrated in FIG. 13, the lower assembly 200 rotates reversely (counterclockwise). When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are closely attached to each other, the water may be fully filled in the upper chamber 152.

What is claimed is:

1. An ice maker comprising:

a tray assembly comprising a tray body defining an ice chamber having a spherical shape and comprising a chamber upper portion defining an upper portion of the ice chamber;

a case configured to be coupled to the tray assembly and comprising (i) an upper plate disposed above the tray assembly and defining a tray opening through which at least a part of an outer surface of the chamber upper portion is exposed and (ii) a vertical extension part extending upward from the upper plate and disposed at a peripheral portion of the tray opening; and a water supply part that is disposed at the vertical extension part and detachably coupled to the case, wherein the water supply part extends downward and is configured to guide water from an outside to an inside of the tray opening, wherein a portion of the chamber upper portion defines an intake opening configured to receive the water from the water supply part, wherein the intake opening is defined at a first side of the vertical extension part at which the tray opening is defined, and at least a part of a water wide path through which water flows by the water supply part is disposed at the first side of the vertical extension part, wherein the tray assembly further comprises an inlet wall extending from the at least a part of an outer surface of the chamber upper portion around an outer circumference of the intake opening to the water supply part, and the inlet wall disposed inside the tray opening, and wherein the tray assembly comprises a first tray and a second tray that are confi sired to be joined together to provide the ice chamber.

2. The ice maker of claim 1, wherein the tray opening defines a space recessed downward from the upper plate.

3. The ice maker of claim 2, wherein the intake opening is disposed in the space, and wherein the water supply part is configured to guide the water from the outside of the tray opening to the intake opening.

4. The ice maker of claim 1, wherein the tray body is coupled to a lower surface of the upper plate.

5. The ice maker of claim 1, wherein the water supply part comprises a fixing part that is detachably coupled to the vertical extension part and that protrudes from an outer surface of the water supply part.

6. The ice maker of claim 5, wherein the vertical extension part defines a fixing slit (i) having a shape concavely cut downward from an upper surface of the vertical extension part and (ii) to which the fixing part is coupled.

7. The ice maker of claim 6, wherein the fixing part comprises a fixing protrusion configured to be received in the fixing slit.

8. The ice maker of claim 7, wherein the fixing protrusion comprises:

an insertion part that extends from the outer surface of the water supply part and that has a width less than or equal to a width of the fixing slit to thereby pass through the fixing slit, and an expansion part that has a width greater than the width of the fixing slit and that is configured to, based on the insertion part being inserted in the fixing slit, be disposed at an outside of the vertical extension part.

9. The ice maker of claim 7, wherein at least one of the fixing slit or the fixing protrusion has a shape that becomes gradually thin downward.

10. The ice maker of claim 5, wherein the vertical extension part defines a fixing hole, and wherein the fixing part comprises a fixing hook that protrudes outward from the outer surface of the water supply part and that passes the fixing hole to be coupled.

11. The ice maker of claim 10, wherein the fixing hook is inserted into the fixing hole in a fitting manner.

12. The ice maker of claim 10, wherein a thickness of the fixing hook gradually decreases downward, and a flat surface is provided at an upper portion of the fixing hook, and wherein the flat surface is configured to, based on the fixing hook being inserted in the fixing hole, be coupled to an upper end of the fixing hole.

13. The ice maker of claim 10, wherein the vertical extension part provides a pair of fixing slits, each having a shape concavely cut downward from an upper surface of the vertical extension part and to which the fixing part, is coupled, wherein the fixing part comprises a pair of fixing protrusions configured to be coupled to the pair of fixing slits, respectively, wherein the fixing hole is defined between the pair of fixing slits, and wherein the fixing hook is provided between the pair of fixing protrusions.

14. The ice maker of claim 13, wherein the fixing hole is disposed below the pair of fixing slits, and the fixing hook is disposed below the pair of fixing protrusions.

15. A refrigerator comprising:

a cabinet defining a storage space; and an ice maker disposed in the storage space, wherein the ice maker comprises:

a tray assembly comprising a tray body defining an ice chamber having a spherical shape and comprising a chamber upper portion defining an upper portion of the ice chamber;

a case configured to be coupled to the tray assembly and comprising (i) an upper plate disposed above the tray assembly and defining a tray opening through which at least a part of an outer surface of the chamber upper portion is exposed and (ii) a vertical extension part extending upward from the upper plate and disposed at a peripheral portion of the tray opening; and a water supply part disposed on the vertical extension part and detachably coupled to the case, wherein the water supply part extends downward and is configured to guide water from an outside to an inside of the tray opening, wherein a portion of the chamber upper portion defines an intake opening to configured to receive the water from the water supply part, wherein the intake opening is defined at a first side of the vertical extension part, and at least a part of a water guide path through which water flows by the water supply part is disposed at the first side of the vertical extension part, wherein the tray assembly further comprises an inlet wall extending from the at least a part of an outer surface of the portion around, an outer circumference of the intake opening to the water supply part, and the inlet wall disposed inside the tray opening, and wherein the tray assembly comprises a first tray and a second tray that are configured to be joined together to provide the ice chamber.

16. The refrigerator of claim 15, wherein the tray opening defines a space recessed downward from the upper plate.

17. The refrigerator of claim 16, wherein the intake opening is disposed in the space, and wherein the water supply part is configured to guide the water from the outside of the tray opening to the intake opening.

18. The refrigerator of claim 15, wherein the tray body is coupled to a lower surface of the upper plate.

19. The refrigerator of claim 15, wherein the water supply part comprises a fixing part that is detachably coupled to the vertical extension part and that protrudes from an outer surface of the water supply part.

20. The refrigerator of claim 19, wherein the vertical extension part defines a fixing hole, and wherein the fixing part comprises a fixing hook that protrudes outward from the outer surface of the water supply part and that passes the fixing hole to be coupled, the fixing hook being inserted into the fixing hole in a fitting manner.

* * * * *